United States Patent [19]

Hirosima

[11] Patent Number: 4,998,041

[45] Date of Patent: Mar. 5, 1991

[54] DEFLECTION YOKE WITH CROSS-ARM STRUCTURE TO REDUCE BEAM MIS-LANDING

[75] Inventor: Kosaku Hirosima, Daito, Japan

[73] Assignee: Sanyo Electric Co., Ltd., Moriguchi, Japan

[21] Appl. No.: 360,791

[22] Filed: Jun. 2, 1989

[30] Foreign Application Priority Data

Jun. 20, 1988 [JP] Japan ..... 63-81219[U]

[51] Int. Cl.[5] ..... H01J 29/76

[52] U.S. Cl. ..... 313/440; 335/211; 335/213

[58] Field of Search ..... 313/440; 335/210, 211, 335/212, 213, 214

[56] References Cited

U.S. PATENT DOCUMENTS 4,556,857 12/1985 Logan ..... 313/440 X

FOREIGN PATENT DOCUMENTS 63-18300 4/1988 Japan .

176639 7/1989 Japan ..... 313/440

*Primary Examiner*—Kenneth Wieder

*Attorney, Agent, or Firm*—Armstrong, Nikaido, Marmelstein, Kubovcik & Murray

[57] ABSTRACT

A deflection yoke which includes a vertical deflection coil, a horizontal deflection coil, and a coil separator for supporting the vertical and horizontal deflectors. The deflection yoke further includes a cross arm attached to the coil separator. The cross arm includes a first portion for absorbing magnetic flux leaked from the vertical deflection coil, and a second portion for discharging magnetic flux. The cross arm further includes a first tongue integral with the first portion and extending perpendicularly therefrom. The cross arm still further includes a second tongue which extends from an end portion of the first tongue and along the axial direction of the deflection yoke in order to provide a cross-arm which corrects misconvergence or mislanding at a corner portion of a display screen.

3 Claims, 6 Drawing Sheets

DEFLECTION YOKE WITH CROSS-ARM STRUCTURE TO REDUCE BEAM MIS-LANDING

BACKGROUND OF THE INVENTION

1. Field of the Invention

The present invention relates to a deflection yoke for use in an in-line type color image receiving tube.

2. Description of the Related Art

In prior art as shown in Japanese Patent Publication No. 18300/1988, a so-called cross arm for correcting a vertical deflection magnetic field is fixed as illustrated in FIG. 6. In other words, FIG. 6 shows that the part (1) is a coil separator provided with a vertical deflection coil (2*a*) and a horizontal deflection coil (see, FIG. 1*a* also showing a horizontal deflection coil 2*b* for the present invention), and wherein on its front enlarged portion (1*a*), a pair of L-letter form pieces (1*b*) are formed. The part (3) is a cross arm which is composed of a first portion (3*a*) for absorbing the vertical leak magnetic field, a second portion (3*b*) for discharging the absorbed magnetic field and a tongue (3*c*) bent at right angles from the first portion.

The cross arm (3) is fixed to the coil separator (1) by accommodating the tongue (3*c*) between the pair of L-letter form pieces (1*b*).

On the other hand, there may be cases for the mislandings of beams respectively occurring at the corner part of the display screen as shown in FIG. 7, even if correction of misconvergence is effected by the above-described cross arm. In other words, as shown by the enlargement on the upper right corner in FIG. 7, the position of the beam (B), shown with a shaded area, relative to the fluorescent element (phosphor) (A) is displaced in the central direction of the display screen. The amount of this displacement is about 25 μm at the corner part of the 29 inch display screen. In this case, also at other three corners of the display screen, the beam is displaced in the central direction.

It has therefore been the practice in the past to attach a magnet (4) to the second portion (3*b*) of the cross arm (3) or to fix a magnet (4) to a position close to the tongue (3*c*), as shown in FIG. 8, when the mislanding, as discussed above, occurred. However, the above-described solution of the prior art in attempting to solve the misalignment problem causes a steep rise in cost and aggravation due to characteristics attributed to the fluctuation of the magnetic force of the magnet or to the irregularity of the fixing position.

SUMMARY OF THE INVENTION

It is therefore an object of this invention to reduce the cost, and improve the characteristic of a deflection yoke in which a cross arm is used so as to prevent the above-described mislanding.

It is therefore a further object of this invention to provide a second tongue forwardly extending at an axial direction of the tube from the end of the first tongue of the cross arm.

These and other features of the invention will be understood upon reading of the following description along with the drawings.

DESCRIPTION OF THE PREFERRED EMBODIMENTS

Figure 1:
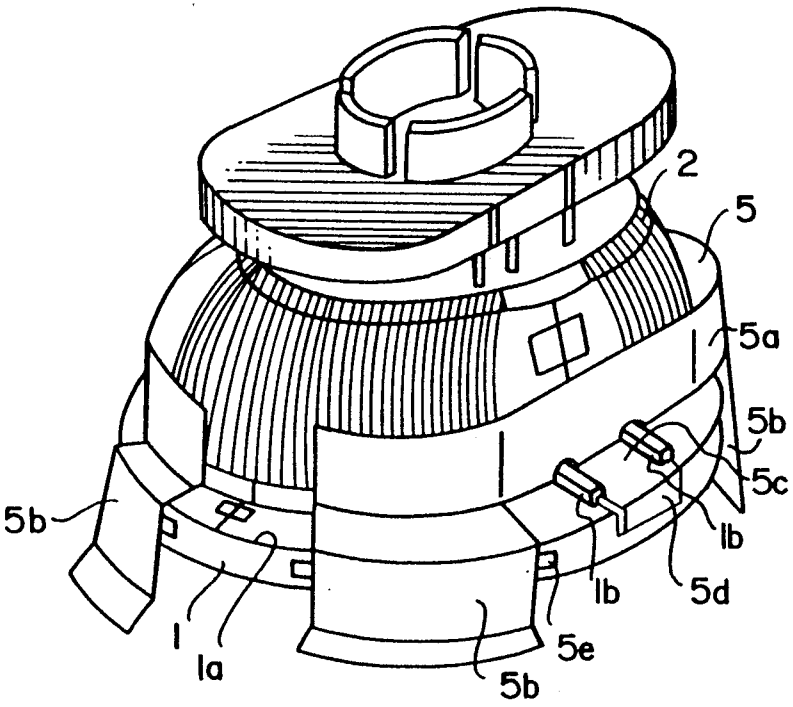
FIG. 1 is a perspective view showing the deflection yoke in one embodiment of the present invention.
Figure 1A:
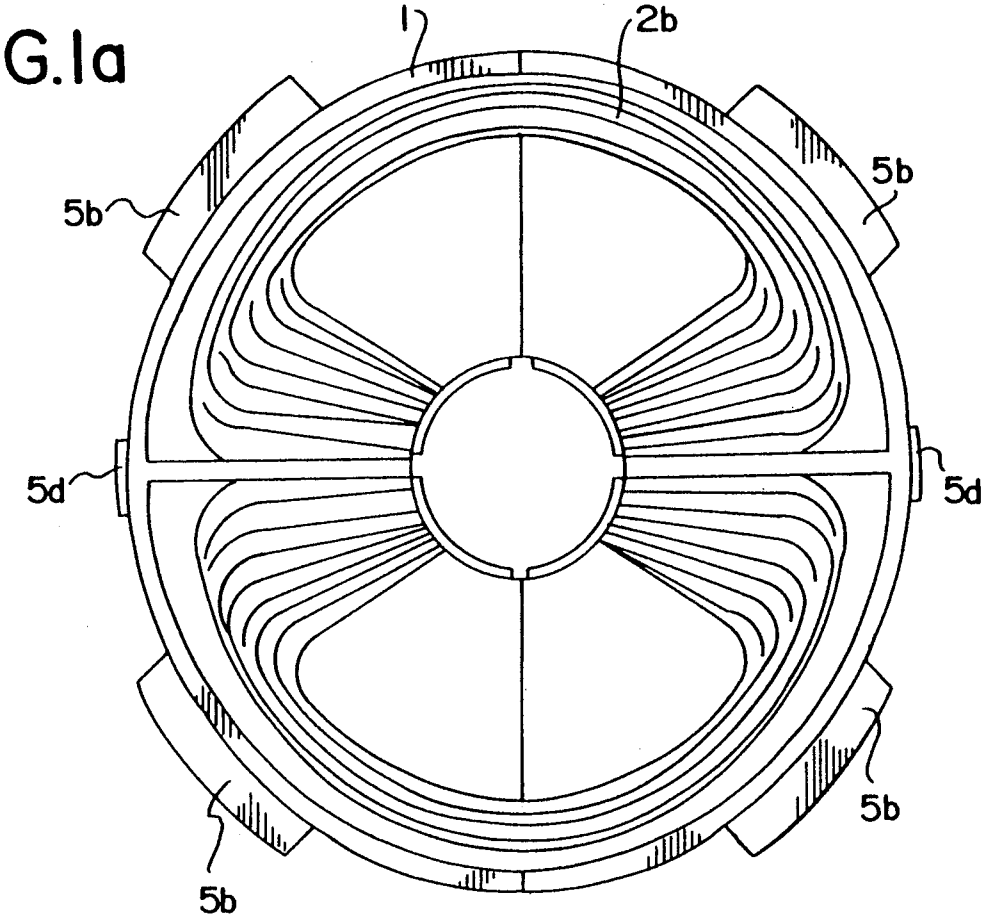
FIG. 1*a* is a front elevational view of the deflection yoke of this invention showing a horizontal deflection coil.
Figure 2C:
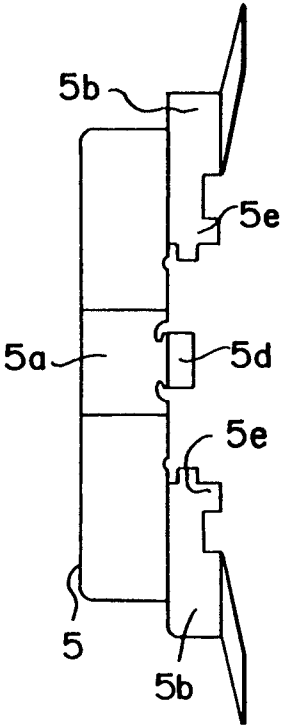
FIG. 2(*a*), FIG. 2(*b*) and FIG. 2(*c*) are perspective view, plan view and side view, respectively, of the cross arm.
Figure 2B:
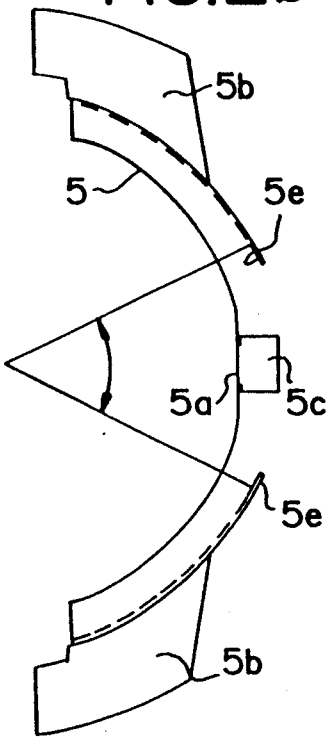
Figure 2A:
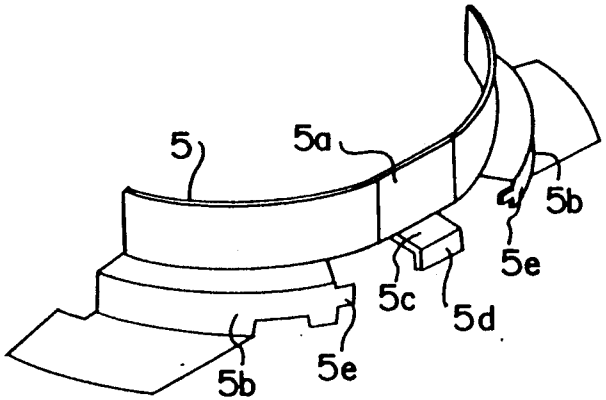
Figure 6:
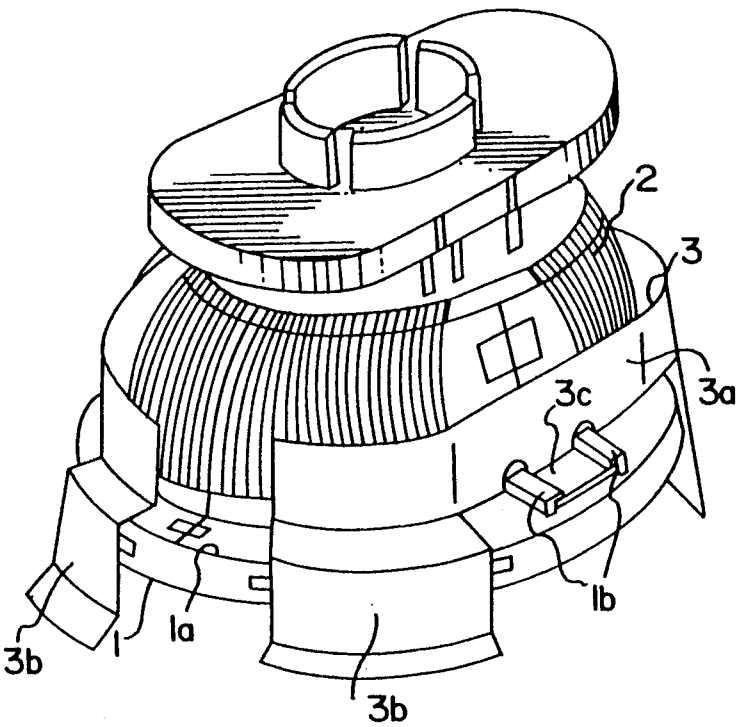
FIG.6 PRIOR ART
FIG. 6 is a perspective view showing the conventional deflection yoke.

FIG. 1 is a perspective view of the deflection yoke in an embodiment of this invention, and FIGS. 2 (*a*), (*b*) and (*c*) are respectively the perspective view, plan view and side view of the cross arm. On the cross arm (5), there are formed the first tongue (5*c*) protruding from the first portion (5*a*) thereof at a right angle, and the second tongue (5*d*) protruding further forward from the first tongue (5*c*) at a right angle. From the second portion (5*b*), there are formed the pieces (5*e*) which project inwardly to each other. In order to fit the cross arm (5) onto the front enlarged portion, the first tongue (5*c*) is caused to slide from the lateral side with respect to a pair of L-letter shaped pieces (1*b*) so as to be accommodated on the front enlarged portion (1*a*), and the second tongue (5*d*) is brought in direct contact with the lateral side of the front enlarged portion (1*a*). The fitted parts are then attached with adhesive.

Figure 3:
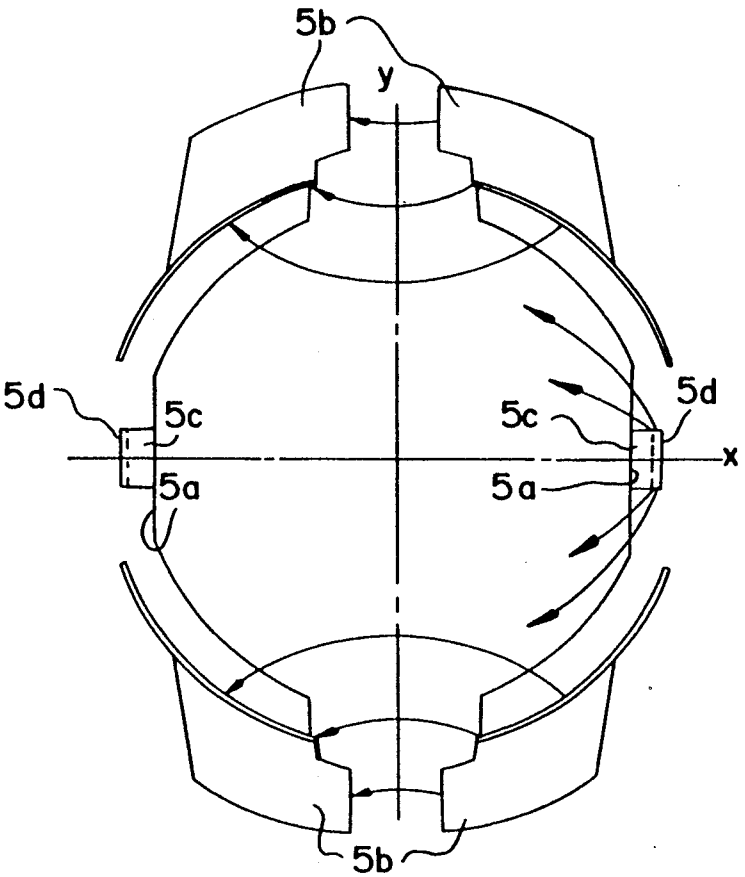
FIG. 3 is a view showing magnetic flux distribution.
Figure 7A:
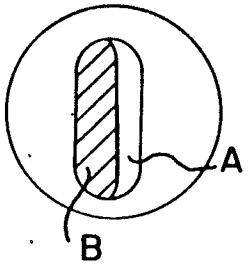
FIG.7a PRIOR ART
FIG. 7 is a schematic view to illustrate a mislanding.
Figure 7:
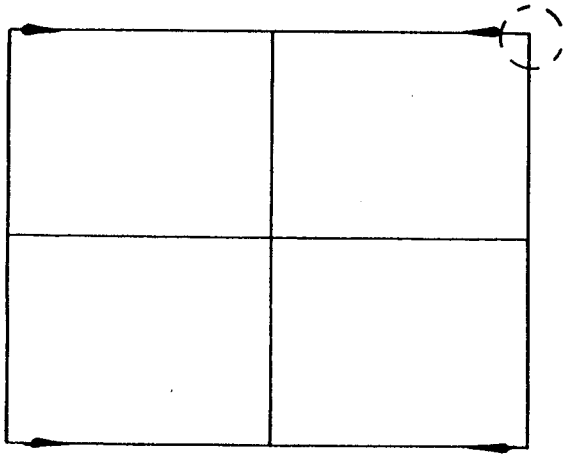
FIG.7 PRIOR ART

In the above-described cross arm (5), magnetic flux is radiated from the second portion (5*b*) in the same manner as described above. Magnetic flux is also radiated from the second tongue (5*d*), as shown in FIG. 3. Since the magnetic flux radiated from the second tongue (5*d*) has a magnetic line which includes a large proportion of y component at the corner part of the display screen, it acts in the direction to correct the mislanding shown in FIG. 7. Using the cross arm of the present embodiment, the amount of displacement between the beam and the phosphor was improved to 10 μm at the corner part of the 29 inch screen.

Figure 5:
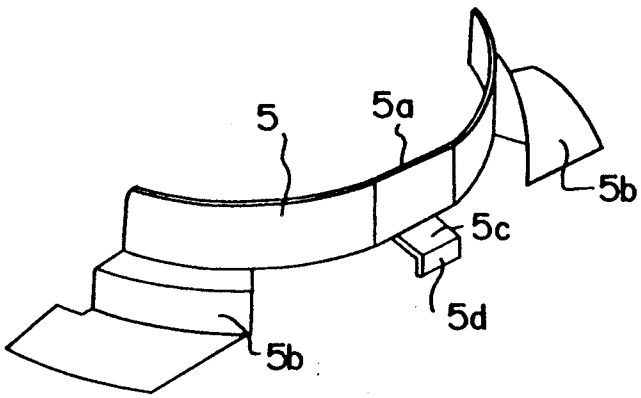
FIGS. 4 and 5 are perspective views showing other embodiments of the cross arm of this invention.
Figure 4:
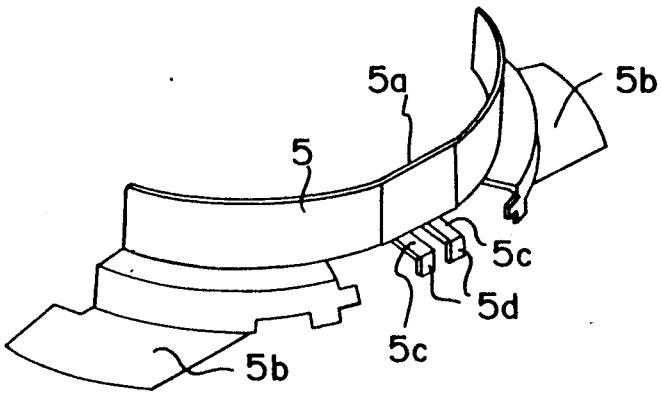
Figure 8:
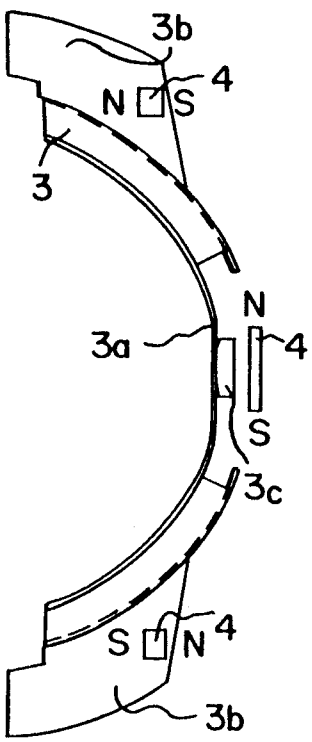
FIG.8 PRIOR ART
FIG. 8 is a plan view of the conventional cross arm.

FIG. 4 and FIG. 5 show other embodiments of this invention. FIG. 4 shows the case where the first tongue (5*c*) and the second tongue (5*d*) are respectively divided into two parts, and FIG. 5 shows the case where the projecting piece (5*e*) is deleted from the second portion (5*b*).

As described above, according to the present invention, by using the cross arm, correction of misconvergence can be achieved.

Further, by forming the second tongue on the cross arm, mislanding at the corner part of the display screen can be prevented.

Further, since the second tongue is provided only by linkage with the first tongue for fitting, the cross arm structure is extremely simple; thus, the deflection yoke of the present invention can be produced at a lower cost than the conventional deflection yoke of the mislanding preventing type.

Furthermore, unlike the conventional deflection yoke as described above, in the yoke of the present invention, no magnet is utilized, so that no irregularity of magnetic force occurs, and improved characteristics are thus obtained.

While the invention has been particularly shown and described in reference to preferred embodiments thereof, it will be understood by those skilled in the art that changes in form and details may be made therein without departing from the spirit and scope of the invention.

What is claimed is:

1. A deflection yoke comprising:

a vertical deflection coil means for generating a barrel-type magnetic field;

a horizontal deflection coil means for generating a pin cushion type magnetic field;

a coil separator means for supporting said vertical deflection coil means and said horizontal deflection coil means;

a cross arm attached to said coil separator meàns, said cross arm having:

a first portion member means for absorbing magnetic flux leaked from said vertical deflection coil means, a second portion member means integral with said first portion member means for discharging magnetic flux, a first tongue integral with said first portion member means and extending perpendicularly therefrom, and a second tongue extending from an end portion of said first tongue and along the axial direction of said deflection yoke.

2. The deflection yoke as in claim 1, wherein said first and second tongues have portions separated from each other.

3. The deflection yoke as in claim 1, wherein in said second portion member means has at least one projection laterally extending therefrom.

* * * * *